US005588550A

United States Patent [19]

Meyer

[11] Patent Number: 5,588,550

[45] Date of Patent: Dec. 31, 1996

[54] COMPARTMENTED CONTAINER INCLUDING CLOSURE WITH ACCESS TO INDIVIDUAL COMPARTMENTS

[75] Inventor: Robert C. Meyer, Wilton, Conn.

[73] Assignee: Pepsico, Inc., Purchase, N.Y.

[21] Appl. No.: 541,313

[22] Filed: Oct. 10, 1995

[51] Int. Cl.[6] ..... B65D 1/04; B65D 51/18

[52] U.S. Cl. ..... 220/525; 220/526; 220/253; 215/6; 222/144.5; 222/145.1; 222/482

[58] Field of Search ..... 215/6; 220/525, 220/526, 529, 532, 543, 544, 253, 254, 255, 256; 222/132, 144.5, 145.1, 145.4, 142.6, 564, 560, 488, 487, 553, 482–484

[56] References Cited

U.S. PATENT DOCUMENTS

| | | | |
|---|---|---|---|
| 557,352 | 3/1896 | Bender . | |
| 1,160,974 | 11/1915 | Clyne | 220/253 |
| 1,750,258 | 3/1930 | Brown . | |
| 1,896,976 | 2/1933 | Schifferdecker | 220/253 |
| 2,123,906 | 7/1938 | Masbach et al. . | |
| 2,192,836 | 3/1940 | Lewis . | |
| 2,381,207 | 8/1945 | Coleman | 220/253 X |
| 2,627,992 | 2/1953 | Kurz | 220/525 |
| 2,665,816 | 1/1954 | Anft . | |
| 2,903,127 | 9/1959 | Dorman . | |
| 3,076,573 | 2/1963 | Thomas . | |
| 3,211,315 | 10/1965 | Griesinger . | |
| 3,358,818 | 12/1967 | Davis . | |
| 4,065,536 | 12/1977 | Lucas . | |
| 4,699,299 | 10/1987 | Gach | 222/482 X |
| 4,792,054 | 12/1988 | Weidman | 220/253 X |
| 5,060,811 | 10/1991 | Fox . | |
| 5,072,849 | 12/1991 | Blau | 220/253 |
| 5,385,270 | 1/1995 | Cataneo et al. | 222/144.5 X |

FOREIGN PATENT DOCUMENTS

| | | | |
|---|---|---|---|
| 1185853 | 8/1959 | France | 220/253 |
| 9005674 | 5/1990 | WIPO . | |

*Primary Examiner*—Allan N. Shoap
*Assistant Examiner*—Nathan Newhouse
*Attorney, Agent, or Firm*—Bachman & LaPointe, P.C.

[57] ABSTRACT

A container of the present invention comprises a body portion including a bottom wall and a side wall defining a cavity and a shoulder portion extending from the body portion and further defining the cavity. A plurality of compartments separated by a partitioning member positioned in the cavity are provided, wherein the compartments and partitioning member extend through the cavity. Each of the compartments are adapted to hold a content. A neck portion extends from the shoulder portion and has an outer wall and an inner wall. A fitment is positioned within the neck portion and engaged with the inner wall. The fitment includes at least a portion thereof in sealed relationship and freely rotatable relative to the neck portion, the portion including a cover substantially traversing the inner wall and having an opening therein. The cover is substantially pressure tight and the opening is rotatable with the portion into and out of alignment with each of the plurality of compartments for providing access to each of the plurality of compartments for removal of the content therefrom without substantial loss of pressure in each of the plurality of compartments.

15 Claims, 2 Drawing Sheets

COMPARTMENTED CONTAINER INCLUDING CLOSURE WITH ACCESS TO INDIVIDUAL COMPARTMENTS

BACKGROUND OF THE INVENTION

This invention is directed towards beverage containers, and more particularly, to a compartmented container for the storage of liquids under pressure, such as carbonated beverages, and a closure for accessing compartments of the compartmented container.

Containers for liquids under pressure are limited in size due to the fact that the pressure means, e.g. a partially dissolved gas, escapes upon opening the container. As in the case of $CO_2$ in a carbonated beverage, taste perception is thereby influenced and, upon repeated opening, the intended taste is substantially lost. Accordingly, there is a practical limit to the size of containers, that is, sizes in which content is consumed all at once, or at least, after a narrowly limited number of openings.

Both beverage distribution and public convenience would greatly benefit if pressurized containers could be of a "family size", as is the case for many other commodities for household use, e.g. cereals, detergents, vegetable oils, and others.

By subdividing the container with compartments the volume of the container is in effect subdivided into units, each of which is capable of duplicating the desirable carbonation retention of the aforesaid small containers, provided that a way is formed to maintain pressure in the compartment from which the beverage is not consumed, while dispensing it only from one compartment at a time.

Accordingly in this invention, means are provided to accomplish such selective and individual opening of the compartments while retaining pressure in the unopened ones.

Certain types of items such as salt and pepper, oil and vinegar, for example, are typically used together, and it was at times preferred to combine such items into separate compartments of a single container. Accordingly, multi-compartment containers exist which allow access to compartments thereof via a plurality of different types of closures. For example, U.S. Pat. No. 3,076,573 to Thomas discloses a multi-compartment bottle having a threaded neck portion adapted to engage a cap-like rotatable dispensing closure. U.S. Pat. No. 5,060,811 to Fox discloses a baby bottle divided into two compartments, a nipple and valve to selectively connect the valve to one or the other of the compartments. Additional embodiments serving the same purpose are shown in U.S. Pat. Nos. 2,665,816 to Anft; 3,211,315 to Greisinger, 3,358,818 to Davis, 557,352 to Bender; and 2,123,906 to Masbach et al. However, none of these containers are directed to maintaining its content under pressure.

There exists, therefore, a need for an improved closure for a multi-compartmented pressurized container which allows for individual access to each compartment thereof and in which pressure is affected substantially only in the compartment to which access is allowed.

SUMMARY OF THE INVENTION

The primary object of this invention is to provide a closure for use with a pressurized, multi-compartmented container, which closure allows access individually to each compartment while maintaining pressure in the compartments where no access is allowed.

Another object of this invention is to provide a closure for a pressurized, multi-compartmented container which allows access to one compartment while blocking access to remaining compartments.

Still another object of this invention is to provide a pressurized closed container having a plurality of compartments and a closure allowing individual access to each of the plurality of compartments one at a time, while maintaining pressure in the compartments that remain closed.

Still another object of this invention is to provide a pressurized, multi-compartmented closed container for holding a liquid under pressure, such as a carbonated beverage.

The foregoing objects and advantages are achieved by the container of the present invention which comprises a body portion including a bottom wall and a side wall defining a cavity and a shoulder portion extending from the body portion and further defining the cavity. A plurality of compartments for pressure-tight separation by a partitioning member positioned in the cavity are provided, wherein the compartments and partitioning member extend through the cavity. Each of the compartments are adapted to hold a content. A neck portion extends upward from the shoulder portion and has an outer wall and an inner wall. A fitment is engaged with the inner wall within the neck portion, in a manner that precludes substantial loss of pressure. The fitment includes at least a portion thereof freely rotatable relative to the neck portion, the portion including a cover substantially traversing the inner wall and having an opening therein. The opening in the cover is rotatable with the portion into and out of alignment with each of the plurality of compartments for providing access to each of the plurality of compartments for removal of the content therefrom and placement of the contents therein while non-accessed compartments remain pressurized.

The details of the present invention are set out in the following description and drawings wherein like reference characters depict like elements.

DETAILED DESCRIPTION OF THE PREFERRED EMBODIMENTS

Figure 1:
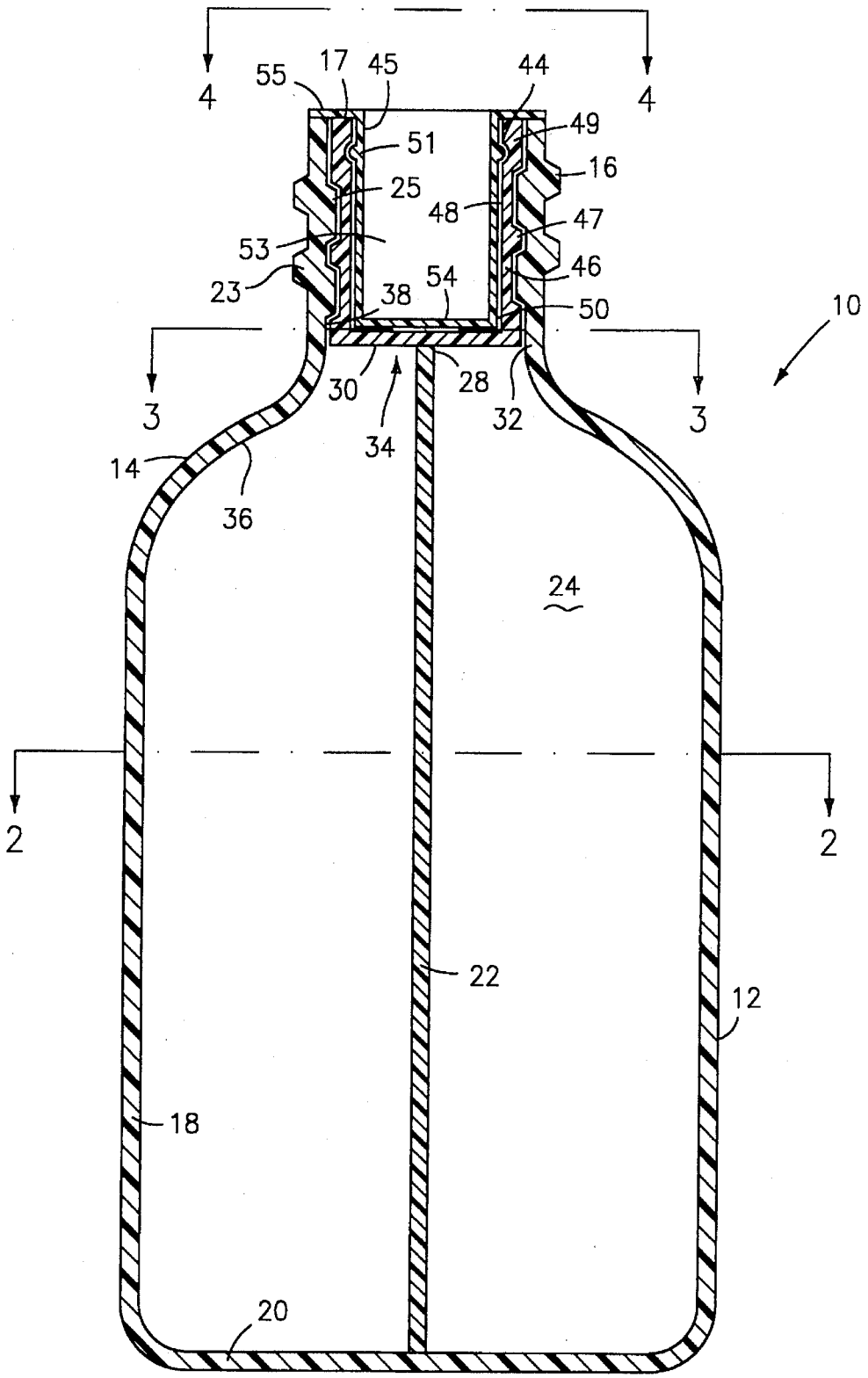
FIG. 1 is a cross-sectional and elevational view of a multi-compartmented container and closure in accordance with the principles of the present invention.

Referring now to the drawings in detail, there is shown in FIG. 1 a partially cross-sectional and elevational view of the container of the present invention, designated generally as 10. Container 10 generally includes body portion 12, shoulder portion 14, neck portion 16, fitment 17 and a cap of conventional design (not shown) preferably being screwed onto the outside of neck portion 16.

Fitment 17 consists of fixed outer member 49 and a rotatable inner member 45.

Body portion 12 preferably includes a circular or cylindrical sidewall 18, a bottom wall 20 connected on the lower edge to sidewall 18, and a partitioning member 22 extending substantially in a longitudinal direction of container 10 and within cavity 24 defined by sidewall 18. Partitioning member 22 is connected to bottom wall 20 extending upwardly to neck portion 16 dividing cavity 24 into a plurality of compartments.

Neck portion 16 may include outer threads 23 for engagement with a cap (not shown) and inner holding means, which may be threads 25 adapted to engage fitment 17, although other means of engagement may be used. If used, inner threads 25 match fitment 17, and may be reverse threads turning counter clockwise, while inner member 45 is arranged to rotate clockwise, thereby precluding disengagement of outer member 49 from neck portion 16.

Figure 2:
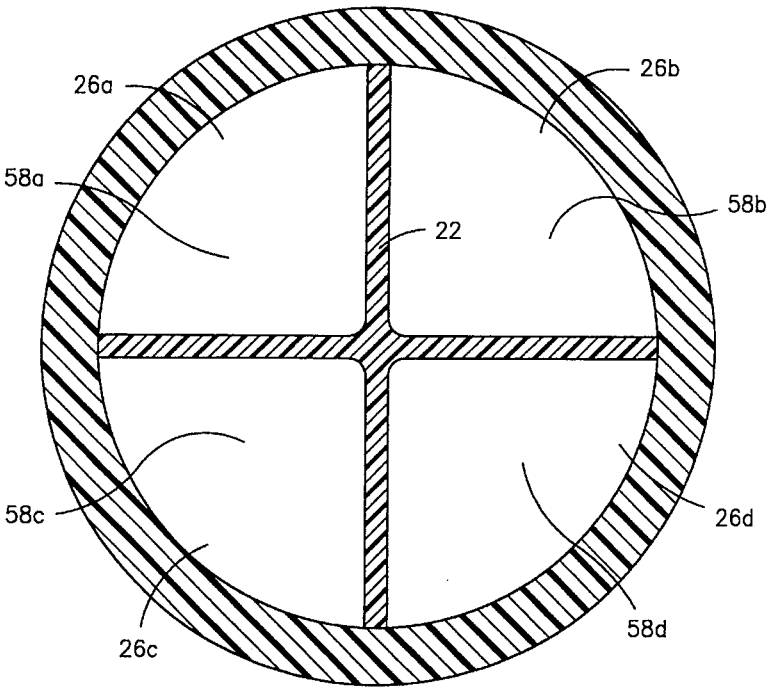
FIG. 2 is an enlarged cross-sectional view taken along line 2—2 of FIG. 1.

As shown in the sectional view of FIG. 2, partitioning member 22 fastened to sidewall 18 in any known manner is used for segregating cavity 24 into a plurality of compartments; although other arrangements for partitioning beyond that shown may be equally applicable. Any number of compartments may be obtained, such as two or more compartments, but usually four compartments 26*a*–26*d*, as shown in FIG. 2, are formed via partitioning member 22. Upper end 28 of partitioning member 22 is in contact with bottom access wall 30 of fitment 17, extending across the lower end 32 of threaded neck portion 16, as shown in FIG. 1.

Figure 3:
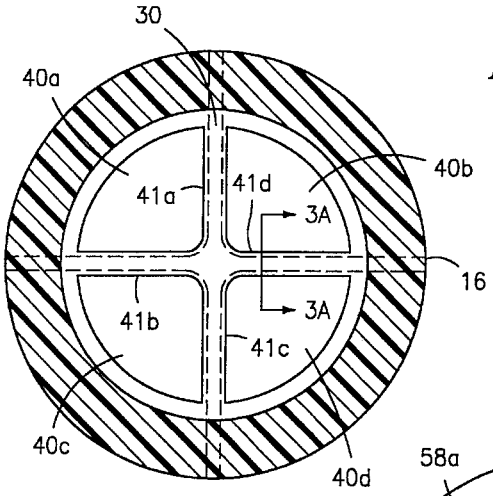
FIG. 3 is a cross-sectional view taken along line 3—3 of FIG. 1.
Figure 3A:
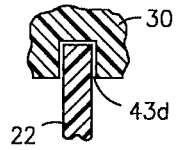
FIG. 3A is an enlarged view taken along line 3A—3A of FIG. 3.

As shown in FIG. 3, bottom access wall 30 extends across the opening 34 at the transition from the inner wall 36 of shoulder portion 14 to the inner wall 38 of threaded neck portion 16. Bottom access wall 30 is permanently attached to and is preferably a part of outer member 49 of fitment 17 and includes a plurality of openings or holes 40*a*–40*d* therein separated by bars 41*a*–41*d*, the holes being in alignment with compartments 26*a*–26*d*, and the bars in alignment with the top surface of partitioning member 22. Bars 41*a*–41*d* are sealably attached to member 22 to resist fluid flow between compartments 26*a*–26*d*, as shown in FIG. 3A, section 3A—3A of FIG. 3, by means of sealing grooves in the lower portion of access wall 30, as sealing groove 43*d* shown in FIG. 3A, into which the upper edges of member 22 extend. Naturally, the sealable attachment would be present for the entire upper surface of member 22.

Figure 4:
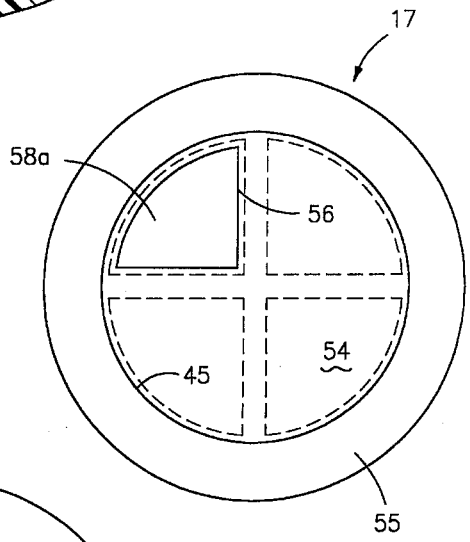
FIG. 4 is an enlarged overhead view of a closure connected to a multi-compartmented container and in alignment with a compartment in accordance with the principles of the present invention.
Figure 5:
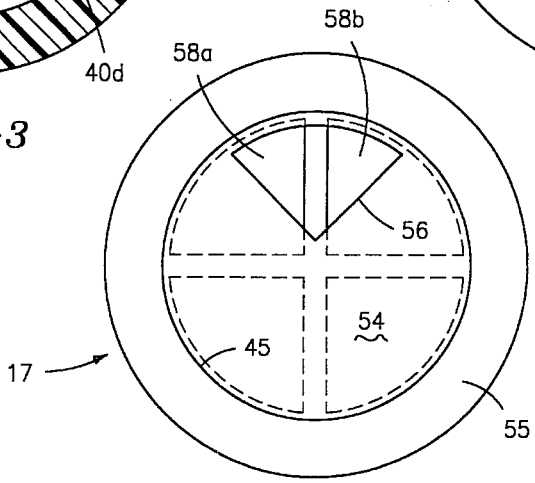
FIG. 5 is an overhead view similar to FIG. 3 showing an opening of the closure partially out of alignment with the compartments of the multi-compartmented container in accordance with the principles of the present invention.

Referring now to FIGS. 1, 4 and 5, outer member 49 includes a circularly shaped outer wall 46 including a set of outer threads 47 adapted to engage inner threads 25 of threaded neck portion 16, as shown in FIG. 1, and an inner substantially circular wall 48 for receiving inner member 45.

Inner member 45 of fitment 17 sealably but rotatably fits in the space defined by inner wall 48 of outer member 49, such as, for example, with a matching taper, and is retained against inner wall 48 by a snap fit protrusion/indentation arrangement 44 which allows rotation while also acting as a seal. Other manners of attachment which maintain rotation while sealing may also be used. Inner member 45 is preferably slightly conical, but substantially cylindrical in shape having an inner circular wall 51 defining a space 53 and having an upper lip or rim 55 extending over the top-most surface of threaded neck portion 16 and outer member 49. Inner member 45 further includes a base or cover 54 attached at the bottom end thereof, against wall 30. Base or cover 54 includes an opening 56, as shown in FIGS. 4 and 5, adapted to be rotated into alignment with openings 40*a*–40*d* of bottom access wall 30, leading to compartments 26*a*–26*d*. Opening 56 is preferably of a shape matching that of openings 40*a*–40*d* in bottom access wall 30, but slightly smaller in size. Base 54 is designed to be stiff enough not to deflect away from wall 30 by the pressure acting against it, thereby substantially precluding the escape of fluid from a non-accessed compartment and maintaining pressure therein.

Accordingly, upon rotation of inner member 45, opening 56 is moved into alignment with one of openings 40*a*–40*d* in bottom access wall 30, such that one of compartments 26*a*–26*b* is given access to space 53 defined by inner wall 51 of inner member 45. The contents within the specific compartment given access to can then be emptied through space 53.

In order to facilitate rotation of inner member 45 together with base 54 that is attached to it, rim 55 is preferably provided with means rendering the turning thereof convenient, for example, surface serrations.

With reference to FIGS. 1–5, in using container 10, a sealing closure or cap therefor (not shown) is provided alongside the container, which sealing closure or cap can be removed and reapplied. Compartments 26*a*–26*d* are filled with contents 58*a*–58*d*. Fitment 17 is then inserted into neck portion 16, whereby opening 56 of base 54 of inner member 45 may at different times be aligned with each of openings 40*a*–40*d*, allowing access to compartments 26*a*–26*d* , respectively. To empty the individual compartments 26*a*–26*d*, opening 56 of base 54 is rotated into alignment with one of openings 40*a*–40*d* of bottom access wall 30 leading into compartments 26*a*–26*d*, respectively. Once alignment is achieved, access can be provided through each of openings 40*a*–40*d* into each compartment 26*a*–26*d*, respectively, depending of course on which one of openings 40*a*–40*d*, opening 56 is aligned.

After alignment is achieved, one of contents 58*a*–58*d* is emptied by tilting the container while retaining the integrity of the unopened compartments. If additional contents from another one of compartments 26*a*–26*d* is desired, base 54 is rotated via rotatable inner member 45 such that opening 56 is in alignment with another of openings 40*a*–40*d*, for exposing and for providing access to another one of compartments 26*a*–26*d* while maintaining pressure in the non-accessed compartments.

While the container and closure have been described as for use with a beverage, it is also contemplated that the sealable nature of this container is such that it could be used as effectively with other products which may need to be maintained fresh, such as, for example, flowable food products.

The primary advantage of this invention is that a closure is provided for use with a pressurized multicompartmented container which closure allows access individually to each compartment while maintaining pressure in the compartments to which no access is allowed. Another advantage of this invention is that a closure is provided for a pressurized multi-compartmented container which allows access to one compartment while sealably blocking access to remaining compartments. Still another advantage of this invention is that a container is provided having a plurality of compartments and a closure is provided allowing individual access to each of the plurality of compartments without substantially affecting pressure in the compartments not accessed. Still another advantage of this invention is that a pressurized multi-compartmented container is provided for holding pressurized fluids.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container, comprising:

a body portion including a bottom wall and a side wall defining a cavity;

a shoulder portion extending from said body portion and further defining said cavity;

a plurality of compartments for holding separate contents, said compartments separated by a partitioning member positioned in said cavity, said compartments and partitioning member extending through said cavity;

a neck portion extending from said shoulder portion having inner and outer wall surfaces, said neck portion defining an opening to said container,said neck inner surface including means for retaining a fitment, wherein said partitioning member terminates below said neck opening and said retaining means; and a fitment positioned within said neck portion and engaged with said inner wall surface, said fitment being in sealed relationship with said neck portion at said retaining means and freely rotatable relative to said neck portion, said portion including a cover substantially traversing said inner wall and having an opening therein;

wherein said cover is substantially pressure tight and said cover opening is rotatable with said portion into and out of alignment with each of said plurality of compartments for providing access to each of said plurality of compartments for removal of said content therefrom without substantial loss of pressure in each of said plurality of compartments not accessed; and an access wall extending over said compartments and partitioning member and sealably attached to said partitioning member, said access wall including a number of holes therein leading to said compartments with each hole corresponding to one of said compartments, wherein said opening aligns with said holes via rotation of said portion for acquiring access to said compartments.

2. The container according to claim 1, wherein said cover is positioned against said wall such that a pressure seal is formed between said cover and said wall.

3. The container according to claim 2, wherein said cover has a stiffness sufficient for preventing pressure from destroying said pressure seal.

4. The container according to claim 1, wherein said access wall and said cover are adjacently positioned such that upon rotation of said portion and said opening into alignment with one of said holes leading to one of said plurality of compartments, said contents within said one of said plurality of compartments may be removed while said content in remaining ones of said plurality of compartments are blocked from removal via said cover.

5. The container according to claim 1, wherein said access wall is nonrotatable and is a lower wall of said fitment.

6. The container according to claim 1, wherein said fitment comprises an outer member which engages said inner wall surface and said portion of said fitment comprises an inner member rotatable relative said outer member.

7. The container according to claim 6, wherein said retaining means is an inner thread for engaging a mating thread on said outer member.

8. The container according to claim 7, wherein said mating thread is a reverse thread.

9. The container according to claim 6, wherein said inner member includes means for lockingly engaging said outer member.

10. The container according to claim 6, wherein said inner member and said outer members are concentrically fitting sleeves.

11. The container according to claim 6, wherein said outer member includes an access wall extending over said compartments, and said cover comprises a part of said inner member and extends adjacent said access wall, wherein said opening of said cover is rotatable into alignment with said holes via the rotation of said inner member.

12. The container according to claim 1, further comprising means for maintaining a pressure seal between said cover and said compartments such that upon alignment of said opening with one of said plurality of compartments, remaining ones of said plurality of compartments maintain pressurized.

13. The container according to claim 1, wherein said neck portion includes external threads, and wherein said partitioning member terminates below said external threads.

14. The container according to claim 1, wherein said access wall includes a groove and the partitioning member is seated in said groove.

15. The container according to claim 1, wherein said access wall is interlocked with the partitioning member.

* * * * *